US006752440B2

(12) United States Patent
Spurr

(10) Patent No.: US 6,752,440 B2
(45) Date of Patent: Jun. 22, 2004

(54) APERTURE CLOSURE SYSTEM

(75) Inventor: Nigel Victor Spurr, Shirley (GB)

(73) Assignee: Arvin Meritor Light Vehicle Systems (UK) Ltd. (GB)

( * ) Notice: Subject to any disclaimer, the term of this patent is extended or adjusted under 35 U.S.C. 154(b) by 0 days.

(21) Appl. No.: 10/241,750

(22) Filed: Sep. 11, 2002

(65) Prior Publication Data

US 2003/0047947 A1 Mar. 13, 2003

(30) Foreign Application Priority Data

Sep. 12, 2001 (GB) ..... 0121928

(51) Int. Cl.[7] ..... E05B 3/00
(52) U.S. Cl. ..... 292/336.3; 292/DIG. 21
(58) Field of Search ..... 292/336.3, 216, 292/DIG. 21, DIG. 29, DIG. 24, DIG. 26

(56) References Cited

U.S. PATENT DOCUMENTS

| | | | | |
|---|---|---|---|---|
| 1,174,652 A | * | 3/1916 | Banks | |
| 1,247,052 A | * | 11/1917 | Wilson | |
| 2,640,720 A | | 6/1953 | Brown | |
| 2,827,321 A | * | 3/1958 | Leslie | 292/5 |
| 2,937,043 A | * | 5/1960 | Griswold | 292/5 |
| 3,146,021 A | * | 8/1964 | Ericson | 296/106 |
| 3,501,189 A | | 3/1970 | Vik | |
| 4,143,904 A | * | 3/1979 | Cooper | 296/57 A |
| 4,157,844 A | * | 6/1979 | Sarosy | 292/48 |
| 4,930,836 A | | 6/1990 | Grinn | |
| 5,295,374 A | * | 3/1994 | Bender | 70/208 |
| 5,749,611 A | | 5/1998 | Watson et al. | |
| 5,803,516 A | | 9/1998 | Hempel | |
| 5,947,536 A | * | 9/1999 | Mizuki | 292/201 |

FOREIGN PATENT DOCUMENTS

| | | |
|---|---|---|
| EP | 0220414 | 8/1986 |

OTHER PUBLICATIONS

Search Report for GB 0121928.6. Date of Search Jan. 16, 2002.

* cited by examiner

*Primary Examiner*—Gary Estremsky
(74) *Attorney, Agent, or Firm*—Carlson, Gaskey & Olds

(57) ABSTRACT

An aperture closure system including a primary closure, a secondary closure, a disabling member, and at least one latch, the secondary closure being releasably retained in a closed position by the at least one latch, the secondary closure having an inside release lever operable via a first transmission path to release the at least one latch, the secondary closure including an external release lever operable to release the at least one latch via a second transmission path, the external release lever being connected to the disabling member, in which when the primary closure and the secondary closure are in their closed positions the primary closure cooperates with the external release lever to move the disabling member, such that the first transmission path is blocked or broken by the disabling member thus preventing the inside release lever from releasing the at least one latch.

14 Claims, 4 Drawing Sheets

APERTURE CLOSURE SYSTEM

RELATED APPLICATIONS

This application claims priority to United Kingdom (GB) patent application number 0121928.6 filed on Sep. 12, 2001.

BACKGROUND OF THE INVENTION

The present invention relates to aperture closure systems, in particular, aperture closure systems for use in vehicles.

Vehicles include a chassis side structure which includes an A pillar, located towards the front of the chassis side structure, a B pillar located towards the centre of the chassis side structure, and a C pillar locate towards the rear of the chassis side structure. The front door is located between the A and B pillar, and the rear door is located between the B and C pillar.

It is known to hinge the front door on the A pillar, and the rear door on the C pillar, such that the doors open in opposing directions. Such doors are operably retained in their respective closed position by respective latches, parts of which are mounted on the front and rear of the B pillar. Operation of front and rear door inside release levers independently releases the doors from the closed position.

SUMMARY OF THE INVENTION

According to the present invention there is provided an aperture closure system including a primary closure, a secondary closure, a disabling member, and at least one latch, the secondary closure being releasably retained in a closed position by the at least one latch, the secondary closure having an inside release lever operable via a first transmission path to release the at least one latch, the secondary closure including an external release lever operable to release the at least one latch via a second transmission path, the external release lever being connected to the disabling member, in which when the primary closure and the secondary closure are in their closed positions the primary closure cooperates with the external release lever to move the disabling member, such that the first transmission path is blocked or broken by the disabling member thus preventing the inside release lever from releasing the at least one latch.

BRIEF DESCRIPTION OF THE DRAWINGS

The present invention will now be described by way of example only with reference to the accompanying drawings in which.

DESCRIPTION OF PREFERRED EMBODIMENT

Figure 1:
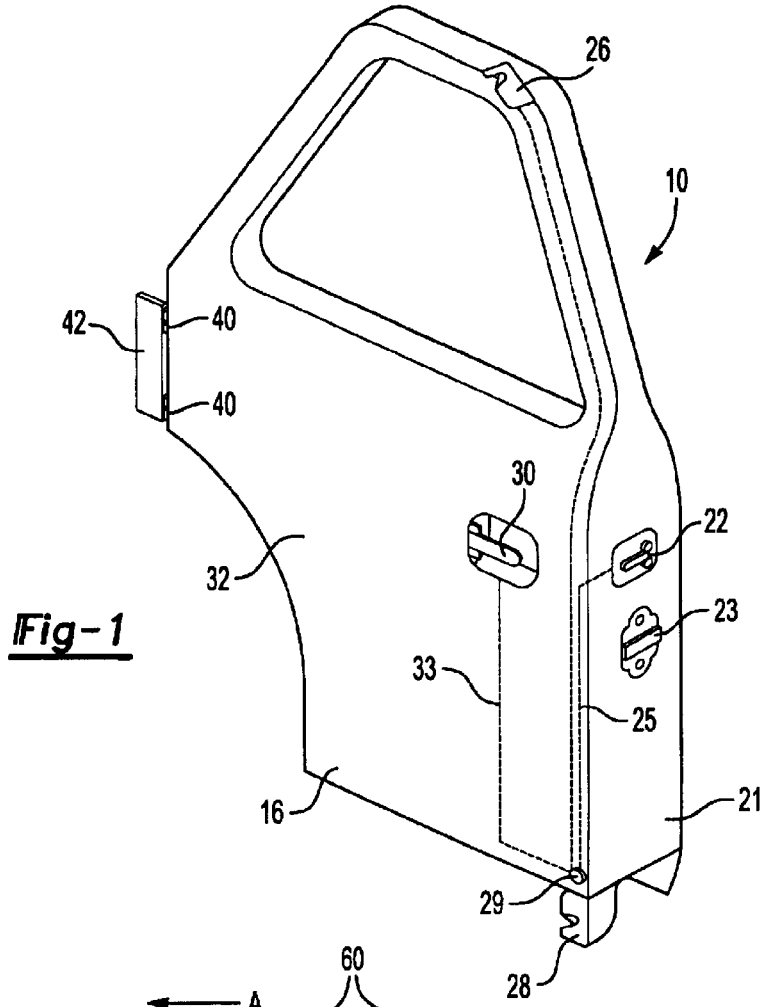
FIG. 1 is a perspective view of an aperture closure system according to the present invention.

With reference to FIGS. 1, 1A, 2 and 3 there is shown an aperture closure system 10 and a vehicle 12 (only part of which is shown).

The vehicle 12 moves in the direction of arrow A when moving in a forwards direction.

The vehicle 12 includes a side chassis structure 13 (only part of which is shown) which includes an A pillar 52 (only part of which is shown) and a C pillar 42 (only part of which is shown).

Figure 1A:
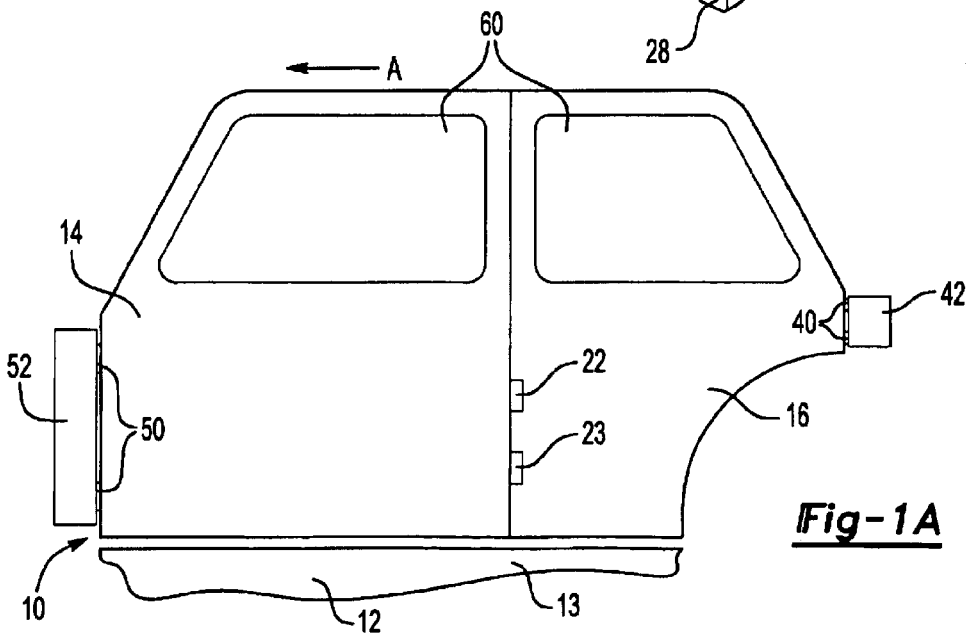
FIG. 1A is a side view of the aperture closure system of FIG. 1, FIGS. 2 to 5 are schematic plan views showing the operation of the aperture closure system of FIG. 1 in a vehicle.
Figure 2:
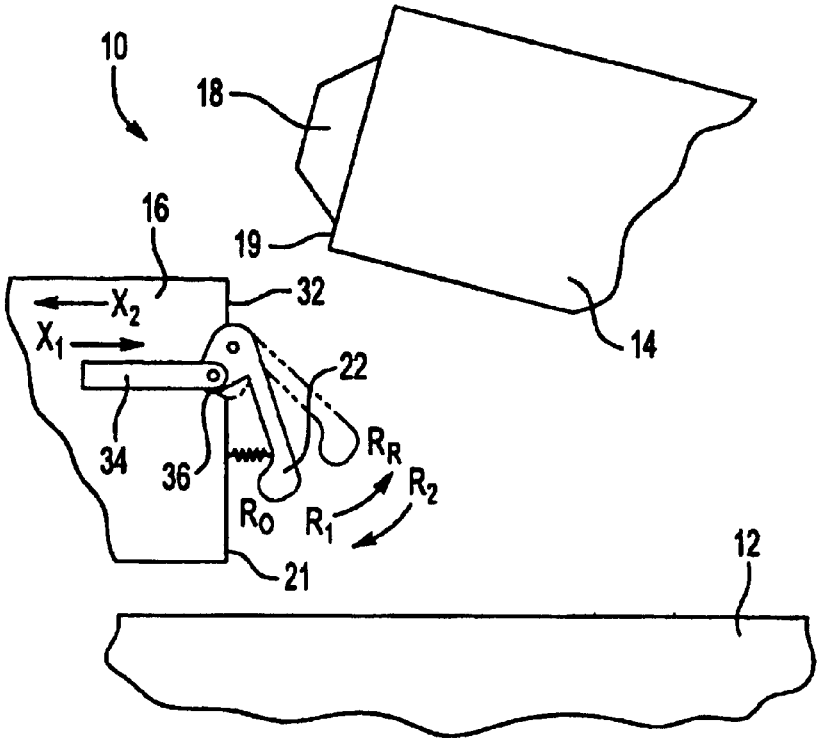
Figure 3:
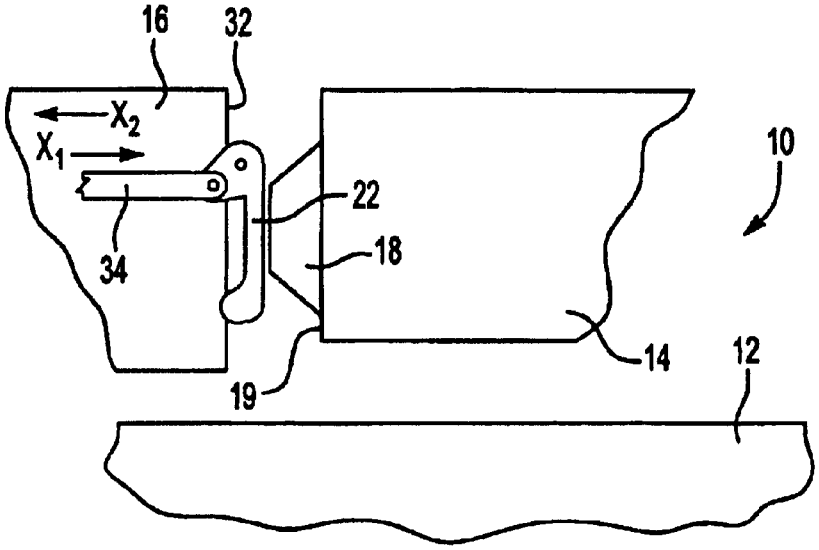

It can be seen from FIG. 1A that there is no B pillar.

The aperture closure system 10 includes a primary closure, in the form of a front door 14, and a secondary closure, in the form of a rear door 16.

The front and rear doors allow access to a passenger compartment 60 (which term is to be understood to include the compartment where a driver of the vehicle is located), by opening sideways, i.e. laterally to the direction of travel A.

The front door 14 includes an engagement portion 18 located on a front door shut face 19. The engagement portion could be integral with the front door, having been formed as part of a pressing process, or the engagement portion could be an additional component which is added to an existing front door.

The rear door has an external release lever 22 (i.e. a lever being normally operated by someone situated externally of the vehicle) which is pivotally mounted on a rear door shut face 21 at pivot 24, and is capable of moving in the direction of arrows $R_1$ and $R_2$. The external release lever is biased, for example by a spring (not shown), such that when free to move it obtains the position shown in FIG. 2 at $R_0$.

The rear door has an inside release lever 30 which is pivotally mounted at pivot 37 on an internal face 32 of the rear door, and is capable of moving in the directions of arrows $P_1$ and $P_2$.

The rear door has a striker 23 which is mounted on the rear door shut face. The striker engages with a front door latch (not shown) to releasably retain the front door to the rear door.

The rear door is hinged at its rear edge at hinge 40, the hinge being located on the C pillar 42.

The front door is hinged at its front edge at hinge 50, the hinge being located on the A pillar 52.

The front door and rear door hinges are positioned such that, when in the closed position, the shut faces 19 and 21 are adjacent each other, with the external release lever cooperating with the engagement portion of the front door, and the striker 23 engaging with the front door latch (not shown).

The rear door has an upper latch 26 which is connected to a lower latch 28, both latches together being capable of releasably retaining the rear door in a closed position.

The lower latch is operated by a release member 29, movement of which releases the lower latch, and hence, since they are connected, the upper latch.

Figure 4:
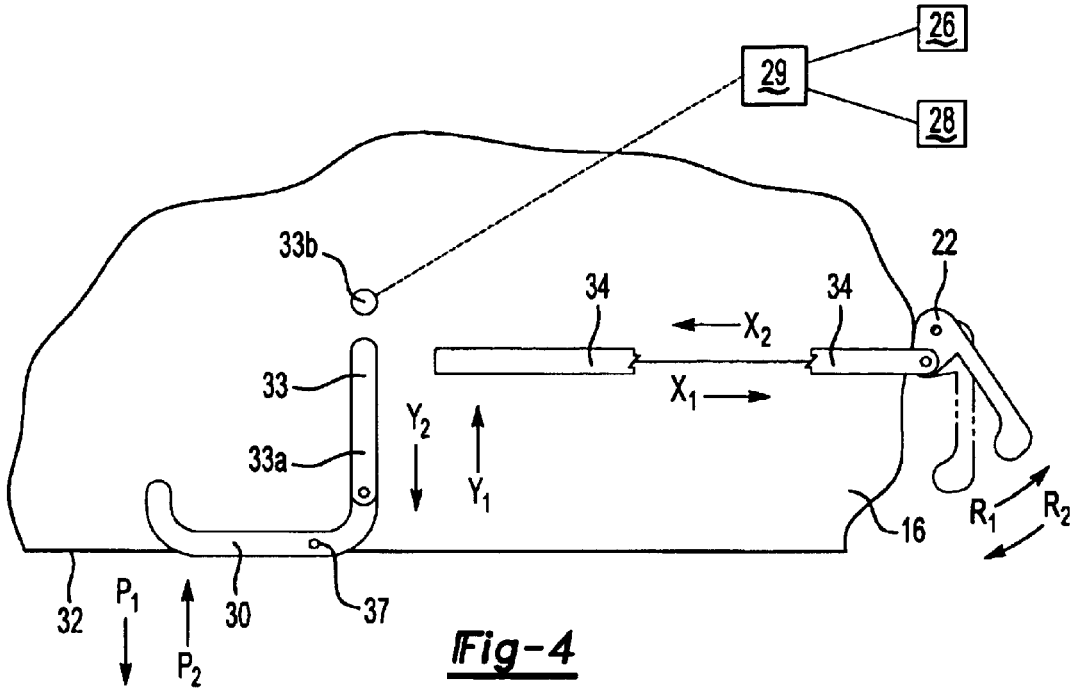
Figure 5:
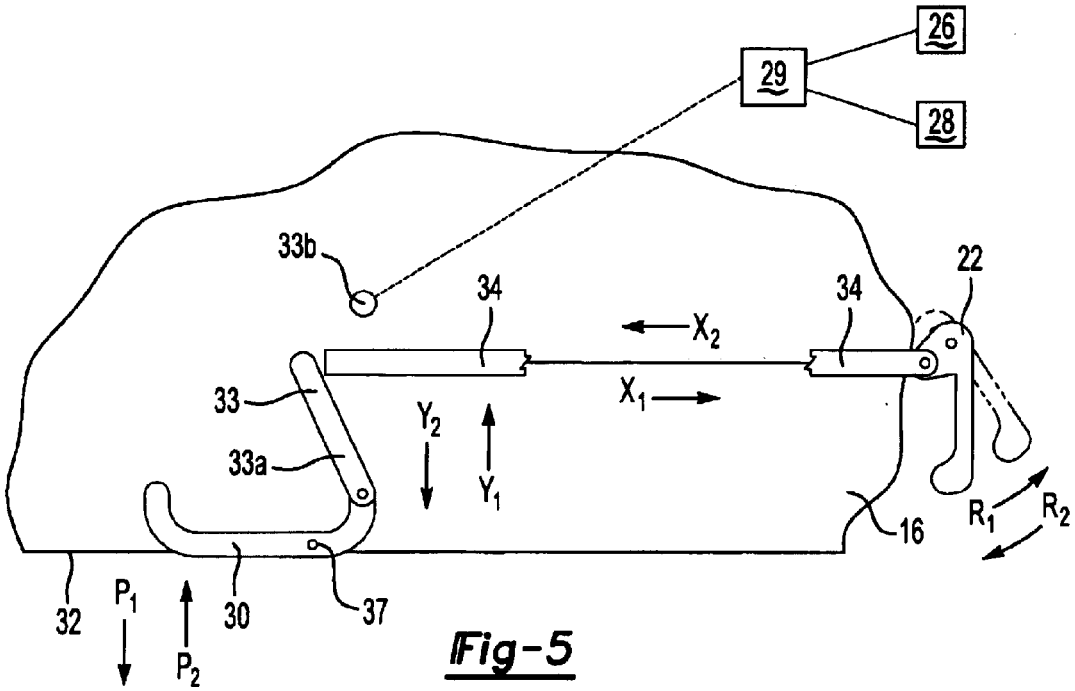

From FIGS. 1, 4 and 5 it can be seen that there is a first transmission path 33 between the inside release lever 30 and the release member 29. The first transmission path 33 comprises two portions 33A and 33B.

Portion 33A is in the form of a lever pivotally attached to the inside release lever 30. Pardon 33B has only been shown schematically and can take various forms including bowden cable or rod form.

From FIG. 1 it can also be seen that there is a second transmission path between the external release lever 22 and the release member 29. The second transmission path is in the form of second mechanical linkage 25 (shown schematically).

A disabling member 34 is connected to the external release lever 22 at position 36, with the disabling member moving in the direction of arrows $X_1$ and $X_2$ when the external release lever moves in the direction of arrows $R_1$ and $R_2$ respectively.

With reference to FIGS. 4 and 5 it can be seen that the disabling means either makes or breaks the transmission path 33 between the inside release lever and the lower latch 28 i.e. the disabling means either allows for or does not allow movement of portion 33A to be transmitted to portion 33B. This concept is known as freewheel locking, where, when disabled, the inside release lever will move but will not release the lower latch.

With the front door in an open position (as in FIG. 2) the external release lever moves the disabling means in the direction of arrow $X_1$ to the position shown in FIG. 4 under action of the spring previously mentioned. In this position it can be seen that the first transmission path 33 is made i.e. connected and that manual movement of the inside release lever in the direction of arrow $P_1$ moves the mechanical linkage 33 such that it moves the release member 29 to release the lower latch.

As the front door is closed, (as in FIG. 3) the external release lever moves the disabling means in the direction of arrow $X_2$ to the position shown in FIG. 5. In this position it can be seen that the first transmission path 33 is broken and that manual movement of the inside release lever in the direction of arrow $P_1$ moves the portion 33A, but, since this portion is misaligned with respect to portion 33B, it does not move the portion 33B and hence does not release the lower latch.

With the front door in an open position, manual movement of the external release lever from an open position $R_0$ to a release position $R_R$ moves the second mechanical linkage 25 such that the release member 29 releases the lower latch. Note that this movement between positions $R_O$ and $R_R$ does not affect the ability to the inside release member to open the door.

Figure 6:
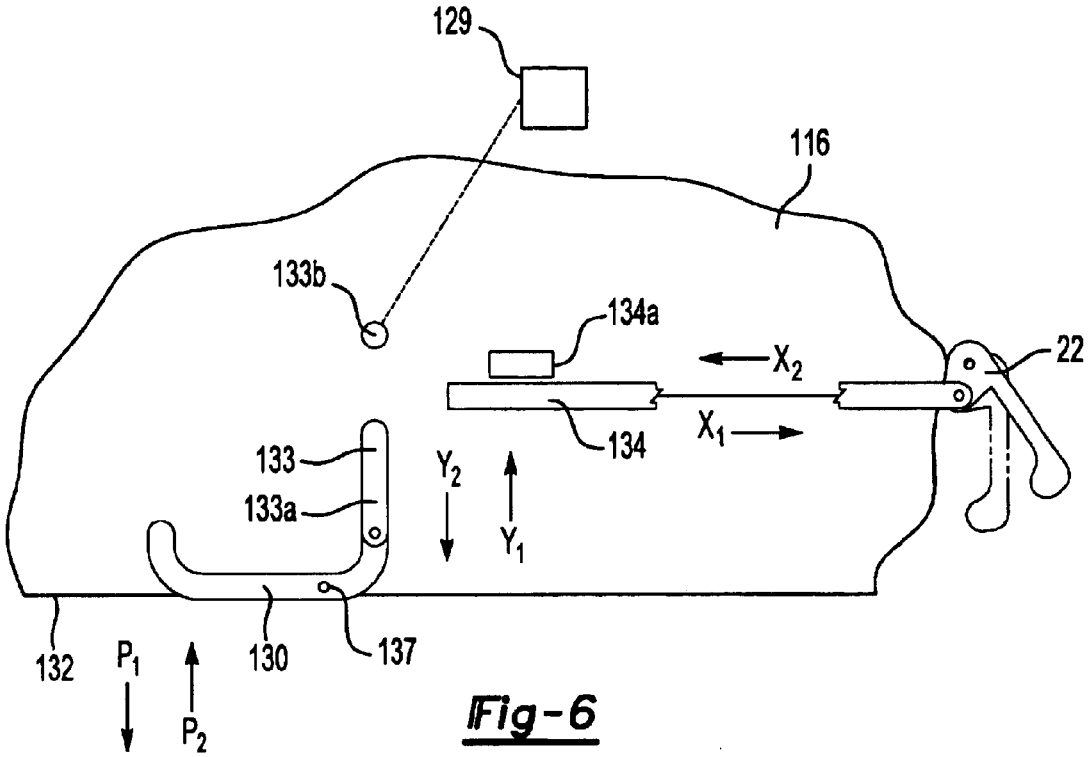
FIGS. 6 and 7 are schematic plan views showing the operation of an alternative aperture closure system in a vehicle.
Figure 7:
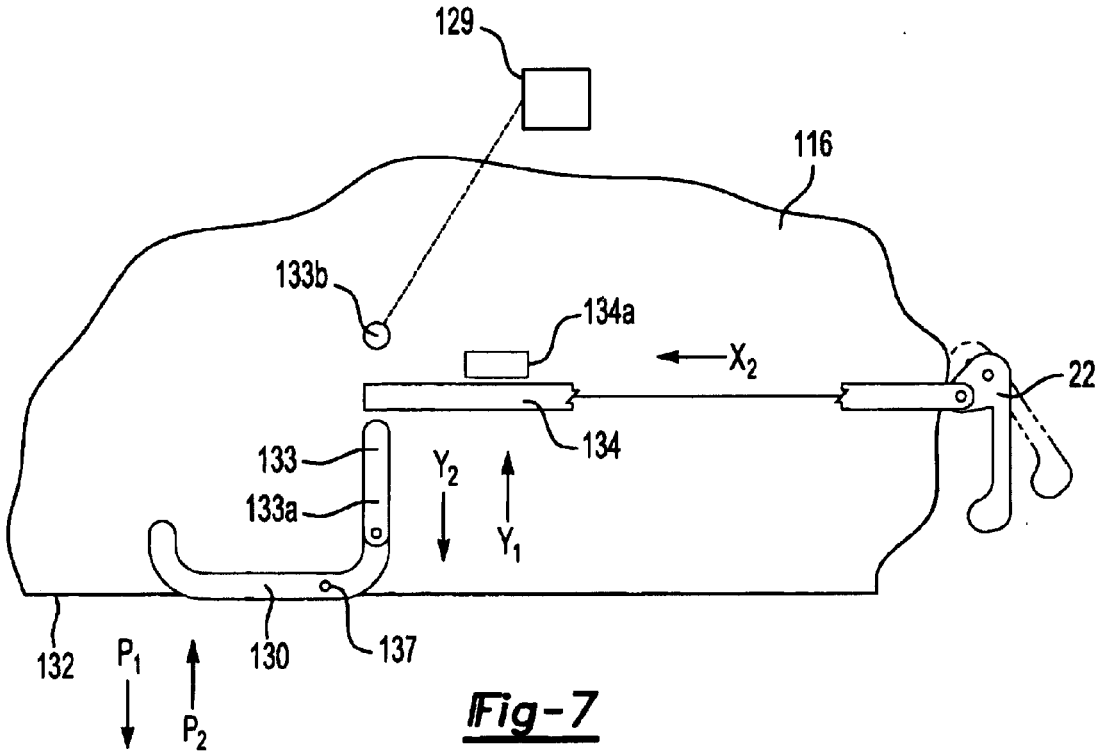

With reference to FIGS. 6 and 7 there is shown an alternative embodiment, in which features that perform the same function as those in FIGS. 4 and 5 are numbered 100 greater.

It can be seen that in this case the disabling means 134 either blocks or unblocks the first transmission path 133 between the inside release lever 130 and the lower latch release member 129. This concept is known as block locking, where, when disabled, the inside release lever will not move and hence will not release the latch.

With the front door in an open position the external release lever moves the disabling means 134 in the direction of arrow $X_1$ to the position shown in FIG. 6. In this position it can be seen that the first transmission path 133 between the inside release lever 130 and the release member 129 (shown schematically) is not blocked by the disabling means 134, i.e. unblocked, and that manual movement of the inside release lever in the direction of arrow $P_1$ moves the mechanical linkage 133 such that it moves the release member 129 to release the lower latch.

As the front door is closed the external release lever moves the disabling means in the direction of arrow $X_2$ to the position shown in FIG. 7. In this position it can be seen that the first transmission path 133 is blocked by the disabling means and that manual movement of the inside release lever in the direction of arrow $P_1$ cannot move the mechanical linkage 133, and does not release the lower latch. This is because abutment 134A prevents disabling means 134 from moving in the $Y_1$ direction.

In other embodiments the first transmission path between the inside release lever and the lower latch may be an electrical first transmission path, such that mechanical movement of the disabling means, as a result of the front door closing, may activate a switch which then sends a signal to a control device which disables the inside release lever, for example, a power opening latch actuator may be disabled.

It can be seen in the above embodiments, that the external release lever is mounted on the rear door shut face, and not on an outside panel of the rear door. Hence there is no need to pierce the outside panel of the rear door, which both reduces manufacturing complexity and improves ergonomics.

What is claimed is:

1. An aperture closure system including a primary closure, a secondary closure, a disabling member, and at least one latch, the secondary closure being releasably retained in a closed position by the at least one latch, the secondary closure having an inside release lever operable via a first transmission path to release the at least one latch, the secondary closure including an external release lever operable to release the at least one latch via a second transmission path, the external release lever being connected to the disabling member, in which when the primary closure and the secondary closure are in their closed positions the primary closure engages the external release lever to move the disabling member, such that the first transmission path is disabled by the disabling member thus preventing the inside release lever from releasing the at least one latch.

2. An aperture closure system according to claim 1 in which the secondary closure has a secondary closure shut face, the external release lever being mounted on the secondary closure shut face, and the primary closure has an engagement portion, the engagement being between the engagement portion and the external release lever.

3. An aperture closure system according to claim 1 in which the first transmission path between the inside release lever and the at least one latch is mechanical.

4. An aperture closure system according to claim 1 in which die first transmission path between the inside release lever and the at least one latch is electrical.

5. An aperture closure system as defined in claim 1 in which the external release lever is mounted on a shut face of the secondary closure.

6. A vehicle including an aperture closure system including a primary closure, a secondary closure, a disabling member, and at least one latch, the secondary closure being releasably retained in a closed position by the at least one latch, the secondary closure having an inside release lever operable via a first transmission path to release the at least one latch, the secondary closure including an external release lever operable to release the at least one latch via a second transmission path, the external release lever being connected to the disabling member, in which when the primary closure and the secondary closure are in their closed positions the primary closure engages with the external release lever to move the disabling member, such that the first transmission path is disabled by the disabling member thus preventing the inside release lever from releasing the at least one latch.

7. A vehicle according to claim 6 in which the primary closure is a front door and the secondary closure is a rear door.

8. A vehicle according to claim 7 in which the primary and secondary closure open laterally relative to the vehicle.

9. A vehicle according to claim 7 in which the primary and secondary closures allow access to a passenger compartment of the vehicle.

10. An aperture closure system including a primary closure, a secondary closure, a disabling mentor, and at least one latch, the secondary closure being releasably retained in a closed position by the at least one latch, the secondary closure having an inside release lever operable via a first transmission path to release the at least one latch, the secondary closure including an external release lever mounted on a shut face of the secondary closure and operable to release the at least one latch via a second transmission path, the external release lever being connected to the disabling member, in which when the primary closure and the secondary closure are in their closed positions the primary closure engages the external release lever to move the disabling member, such that the first transmission path is disabled by the disabling member thus preventing the inside release lever from releasing the at least one latch.

11. The claim as recited in claim 10, wherein said external release lever is movable between a first position engaged with said primary closure disabling said first transmission path, a second position disengaged from said primary closure enabling said first transmission path, and a third position causing actuation of said at least one latch through said second transmission path.

12. The claim as recited in claim 11, wherein said first transmission path comprises a first portion engageable with a second portion to enable operation of said first transmission path, said first portion movable in response to said inside release lever to engage said second portion, and said disablement member is movable in response to movement of said external release lever, wherein movement of said external release lever to said first position causes movement of said disablement member to disable engagement between said first and second portion of said first transmission path.

13. The claim as recited in claim 12, wherein said first portion comprises a lever pivotally attached to said inside release lever and movement of said disablement member selectively aligns said lever with said second portion.

14. The claim as recited in claim 12, wherein said first portion comprises a lever pivotally attached to said inside release lever and movement of said disablement member selectively blocks engagement between said first portion and said second portion.

* * * * *

UNITED STATES PATENT AND TRADEMARK OFFICE

CERTIFICATE OF CORRECTION

PATENT NO. : 6,752,440 B2
DATED : June 22, 2004
INVENTOR(S) : Spurr

It is certified that error appears in the above-identified patent and that said Letters Patent is hereby corrected as shown below:

Column 4,
Line 39, “die” should be -- the --.

Signed and Sealed this

Third Day of August, 2004

JON W. DUDAS
*Acting Director of the United States Patent and Trademark Office*